US010060692B2

(12) United States Patent
Couie

(10) Patent No.: US 10,060,692 B2
(45) **Date of Patent: *Aug. 28, 2018**

(54) FIREARM MAGAZINE LOADER AND UNLOADER

(71) Applicant: William Christopher Couie, Vidalia, LA (US)

(72) Inventor: William Christopher Couie, Vidalia, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/638,962

(22) Filed: Jun. 30, 2017

(65) Prior Publication Data

US 2018/0080729 A1 Mar. 22, 2018

Related U.S. Application Data

(63) Continuation-in-part of application No. 15/487,238, filed on Apr. 13, 2017, now Pat. No. 9,921,016, which is a continuation-in-part of application No. 15/440,984, filed on Feb. 23, 2017.

(60) Provisional application No. 62/445,058, filed on Jan. 11, 2017, provisional application No. 62/396,643, filed on Sep. 19, 2016.

(51) Int. Cl.

| | |
|---|---|
| ***F41A 9/83*** | (2006.01) |
| ***F41A 9/67*** | (2006.01) |
| ***F41A 9/84*** | (2006.01) |
| *F41A 9/65* | (2006.01) |

(52) U.S. Cl.

CPC ..... *F41A 9/83* (2013.01); *F41A 9/67* (2013.01); *F41A 9/84* (2013.01); *F41A 9/65* (2013.01)

(58) Field of Classification Search

CPC ..... F41A 9/83; F41A 9/84

See application file for complete search history.

(56) References Cited

U.S. PATENT DOCUMENTS

| | | | | | |
|---|---|---|---|---|---|
| 4,304,062 | A * | 12/1981 | Pepe | F41A 9/83 | 42/87 |
| 4,827,651 | A * | 5/1989 | Conkey | F41A 9/83 | 42/87 |
| 4,993,180 | A * | 2/1991 | Upchurch | F41A 9/83 | 42/87 |
| D477,047 | S * | 7/2003 | Springer | D22/108 | |
| 7,257,919 | B1 * | 8/2007 | Farley | F41A 9/83 | 42/87 |
| 7,503,138 | B2 * | 3/2009 | Tal | F41A 9/83 | 42/50 |
| 7,637,048 | B2 * | 12/2009 | Tal | F41A 9/83 | 42/87 |
| 7,805,874 | B2 * | 10/2010 | Tal | F41A 9/84 | 42/87 |
| 9,212,859 | B1 * | 12/2015 | Tal | F41A 9/83 | |

(Continued)

*Primary Examiner* — Stephen Johnson
*Assistant Examiner* — Joshua T Semick
(74) *Attorney, Agent, or Firm* — IDP Patent Services; Olay M. Underdal

(57) ABSTRACT

A magazine loader/unloader, designed to stand on a table or be handheld during use, includes a loader/unloader housing, including right and left sides, front and rear sides, and a flat bottom plate; a loading structure, including a loading member; and an unloading structure, including top and bottom guides, and an unloading protrusion. Also disclosed is a method of using the magazine loader/unloader, including positioning cartridge, loading cartridge, and unloading cartridge.

23 Claims, 11 Drawing Sheets

(56) References Cited

U.S. PATENT DOCUMENTS

| | | | | |
|---|---|---|---|---|
| 9,239,198 | B2 * | 1/2016 | McPhee | F41A 9/83 |
| 2013/0232843 | A1 * | 9/2013 | Bajuelo | F41A 9/83<br>42/87 |

* cited by examiner

Magazine Loader/Unloader

Magazine Loader/Unloader

Magazine Loader/Unloader

Method of using the magazine loader/unloader

FIREARM MAGAZINE LOADER AND UNLOADER

CROSS-REFERENCE TO RELATED APPLICATIONS

This U.S Non-Provisional application is a continuation-in-part of U.S. Non-Provisional application Ser. No. 15/487,238, filed Apr. 13, 2017, which is a continuation-in-part of U.S. Non-Provisional application Ser. No. 15/440,984, filed Feb. 23, 2017, which claims the benefit of U.S. Provisional Application No. 62/445,058, filed Jan. 11, 2017 and of U.S. Provisional Application No. 62/396,643, filed Sep. 19, 2016.

FIELD OF THE INVENTION

The present invention relates generally to the field of firearm magazines, and more particularly to devices, methods and systems for loading and unloading a firearm magazine.

BACKGROUND OF THE INVENTION

Use of semi-automatic firearms require tedious and time-consuming loading and unloading of magazines. Loading and unloading devices are available, but are generally complicated devices, which only are capable of either loading or unloading.

As such, considering the foregoing, it may be appreciated that there continues to be a need for novel and improved devices and methods for loading and unloading a firearm magazine.

SUMMARY OF THE INVENTION

The foregoing needs are met, to a great extent, by the present invention, wherein in aspects of this invention, enhancements are provided to the existing model of loading and unloading a firearm magazine.

In an aspect, a magazine loader/unloader, can include:

a) a loader/unloader housing, which is hollow and defines a housing interior with an upper opening, such that the loader/unloader housing can be configured to accept an upper end of a firearm magazine, via insertion of the firearm magazine through the upper opening; and b) a loading structure, including:

a loading member, which is mounted inside the housing interior, wherein the loading member includes an upper surface that is configured to accept a firearm cartridge;

wherein, when the firearm cartridge is inserted into the housing interior and positioned in the loading member, and the firearm magazine is depressed downward into the housing interior, the loading member is configured to depress the firearm cartridge into the firearm magazine, such that a forward motion of the magazine pushes the firearm cartridge rearward in the firearm magazine, whereby the ammunition is securely loaded within the firearm magazine.

In a related aspect, the magazine loader/unloader of claim 1 can further include:

a bottom plate, which is configured with a flat bottom surface;

such that the magazine loader/unloader is configured to be positioned on a flat surface, such as a table, during loading of cartridges.

In yet a related aspect, the magazine loader/unloader of claim 1 can further include:

an unloading structure, which is mounted on an outer side of the loader/unloader housing, the unloading structure comprising:

an unloading protrusion;

wherein, when the unloading structure is placed on a top of the firearm magazine, such that when the unloading protrusion is positioned against a rear of the firearm magazine and the magazine loader/unloader is pushed forward, the unloading protrusion is configured to engage with a rear end of the firearm cartridge and move the firearm cartridge forward, such that the firearm cartridge is ejected from the firearm magazine.

In a further related aspect, the unloading structure can further include top and bottom guides;

wherein the top guide is parallel to the bottom guide and positioned above the bottom guide;

such that the top and bottom guides are configured to guide the smooth forward sliding motion of the firearm magazine and ensure positioning of the firearm cartridge relative to the unloading protrusion, such that the unloading protrusion engages the firearm cartridge.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Figure 1A:
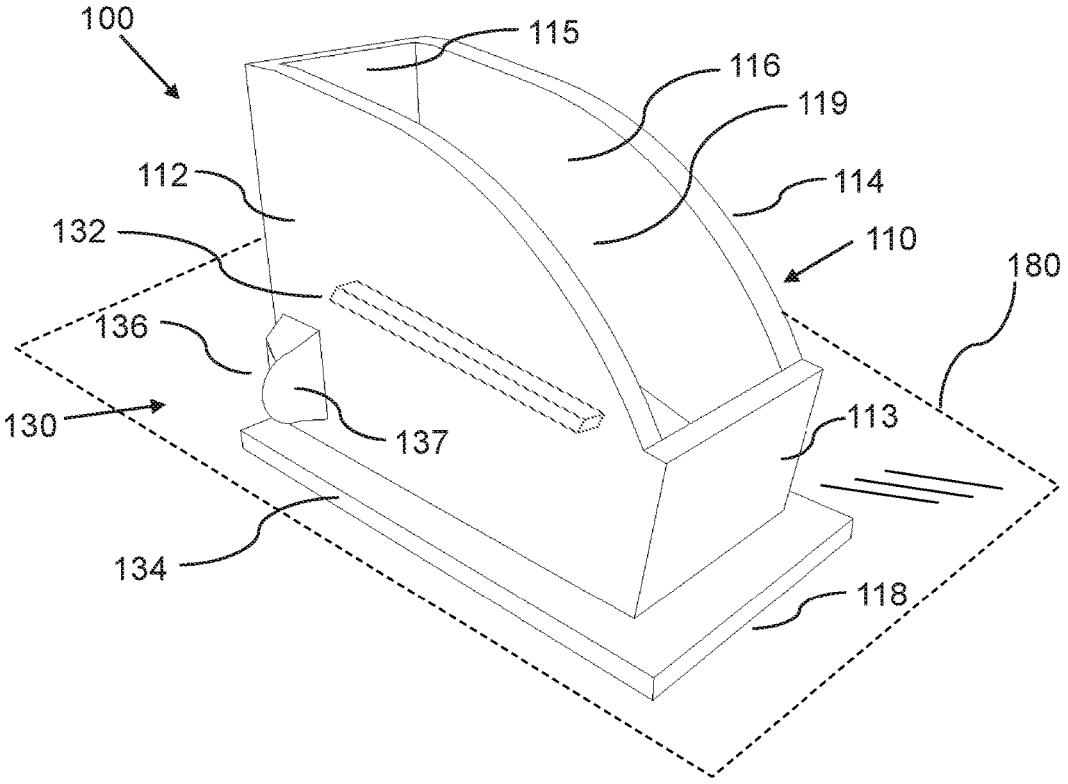
FIG. 1A is a perspective view of a magazine loader/unloader, according to an embodiment of the invention.
Figure 1B:
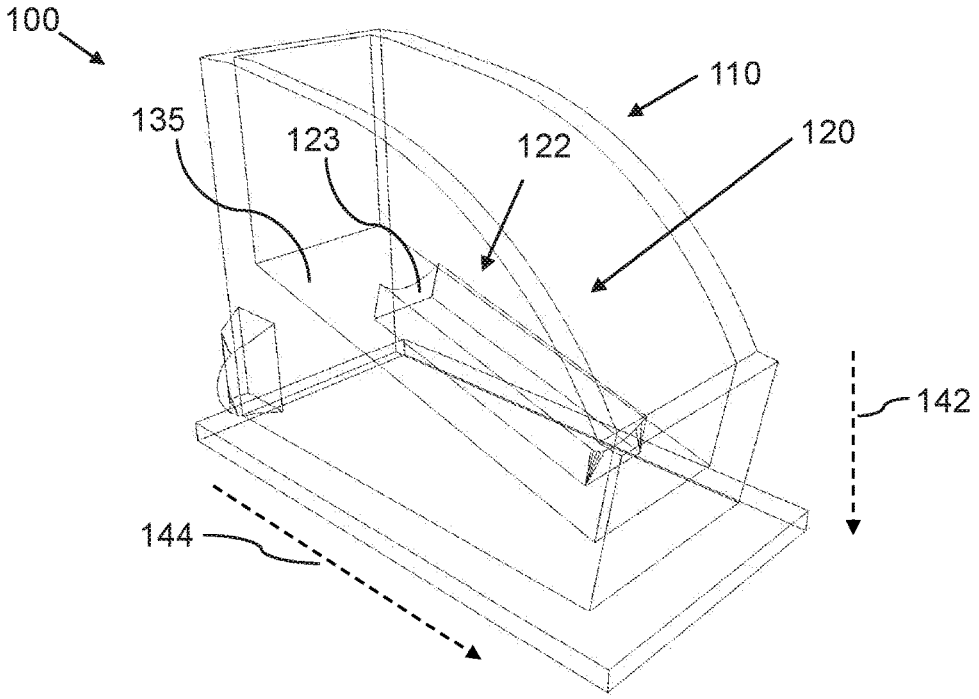
FIG. 1B is a perspective view of a magazine loader/unloader showing a transparent view of inside structure, according to an embodiment of the invention.
Figure 2:
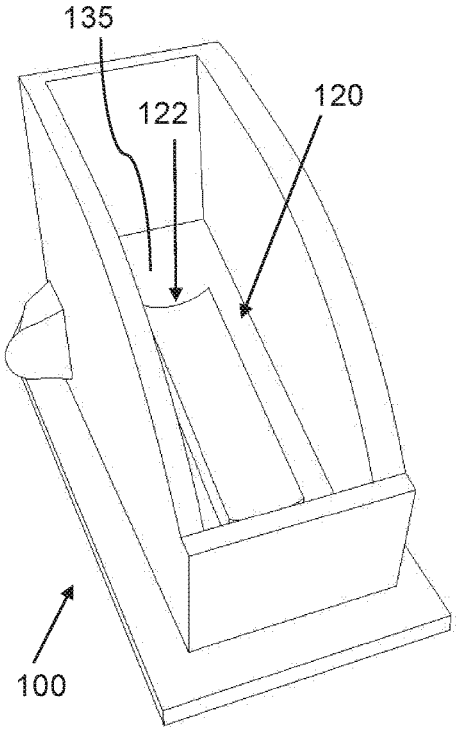
FIG. 2 is a front top perspective view of a magazine loader/unloader, according to an embodiment of the invention.
Figure 3:
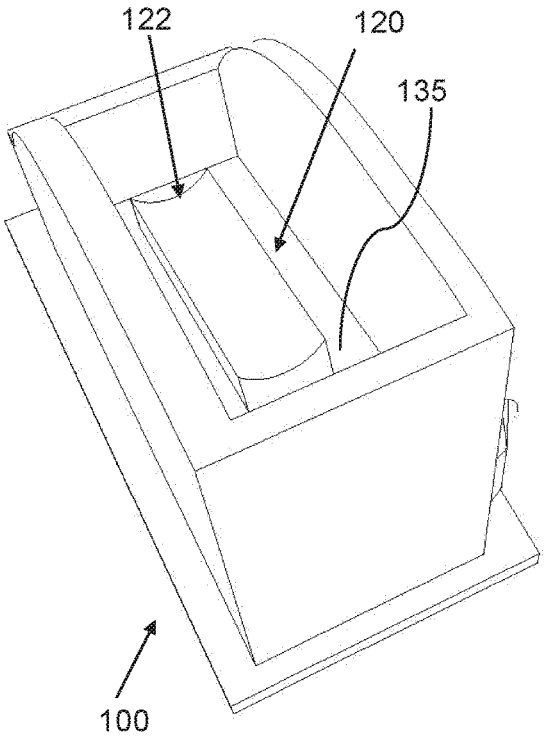
FIG. 3 is a rear top perspective view of a magazine loader/unloader, according to an embodiment of the invention.

In the following, we describe the structure of an embodiment of a magazine loader/unloader 100 with reference to FIG. 1, in such manner that like reference numerals refer to like components throughout; a convention that we shall employ for the remainder of this specification.

Figure 4A:
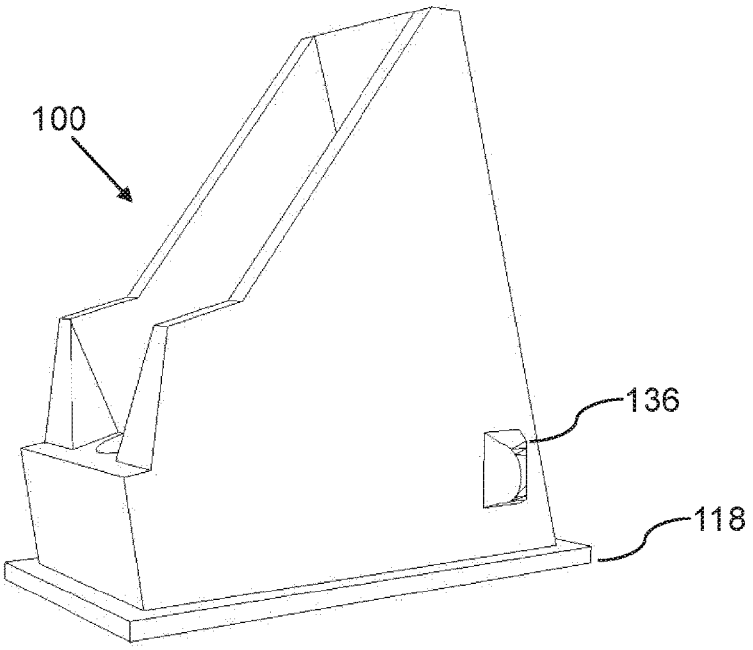
FIG. 4A is a side perspective view of a magazine loader/unloader, according to an embodiment of the invention.
Figure 4B:
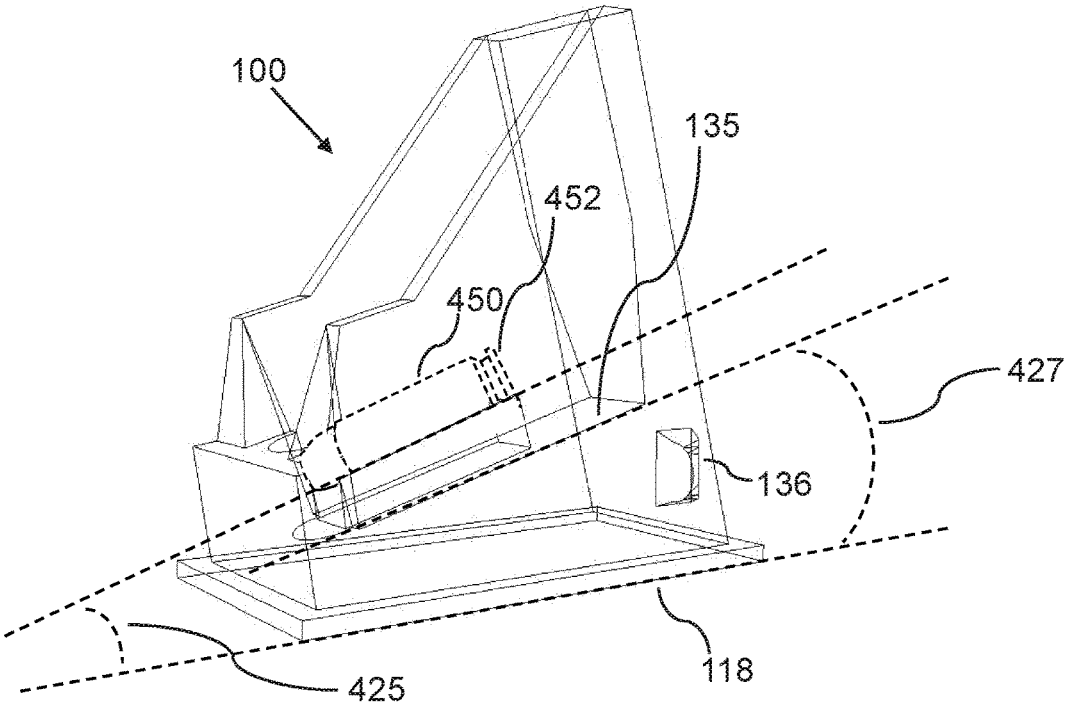
FIG. 4B is a side perspective view of a magazine loader/unloader showing a transparent view of inside structure, according to an embodiment of the invention.
Figure 6A:
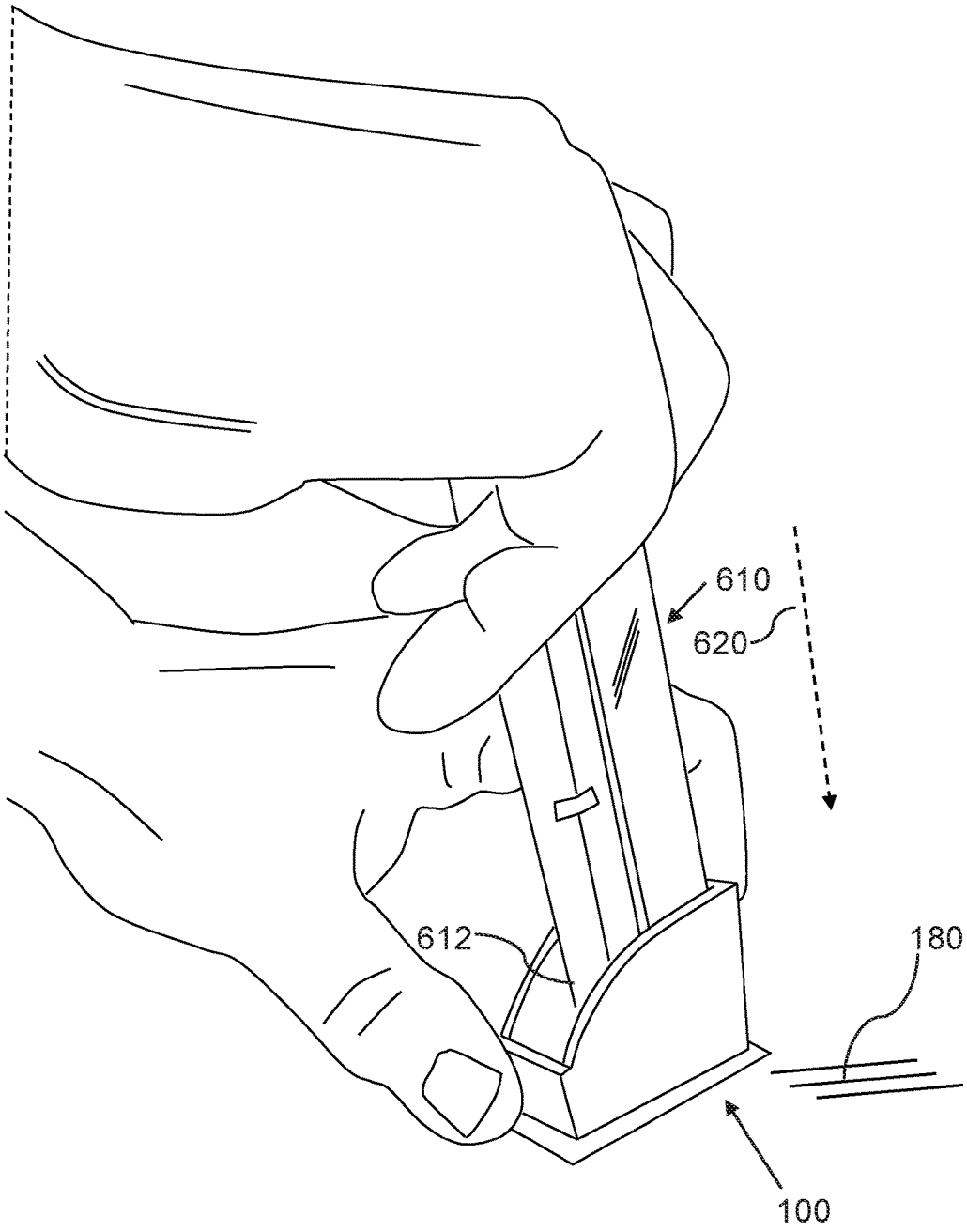
FIG. 6A is a perspective view of a magazine loader/unloader in use for loading a magazine, according to an embodiment of the invention.
Figure 6B:
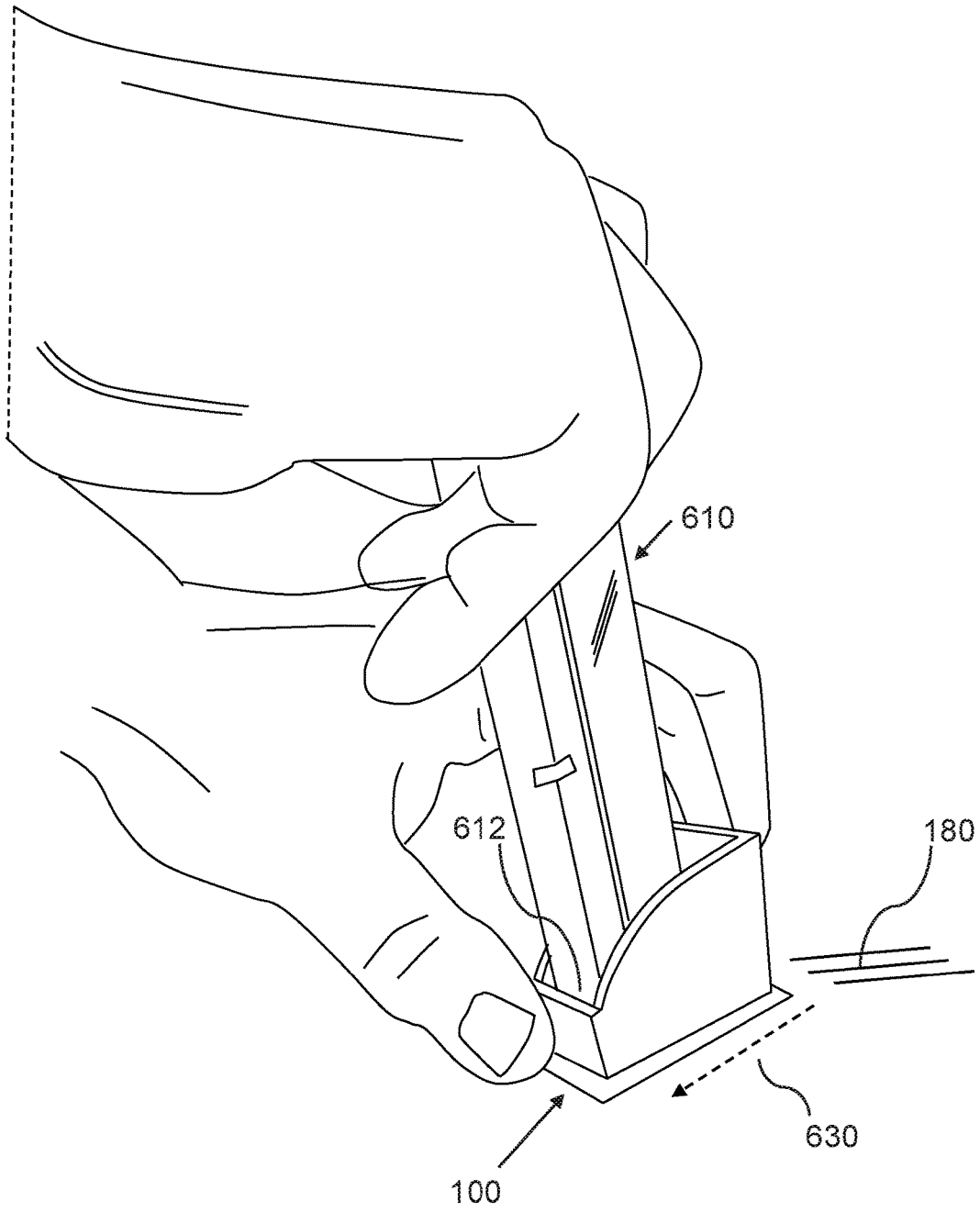
FIG. 6B is a perspective view of a magazine loader/unloader in use for loading a magazine, according to an embodiment of the invention.
Figure 7A:
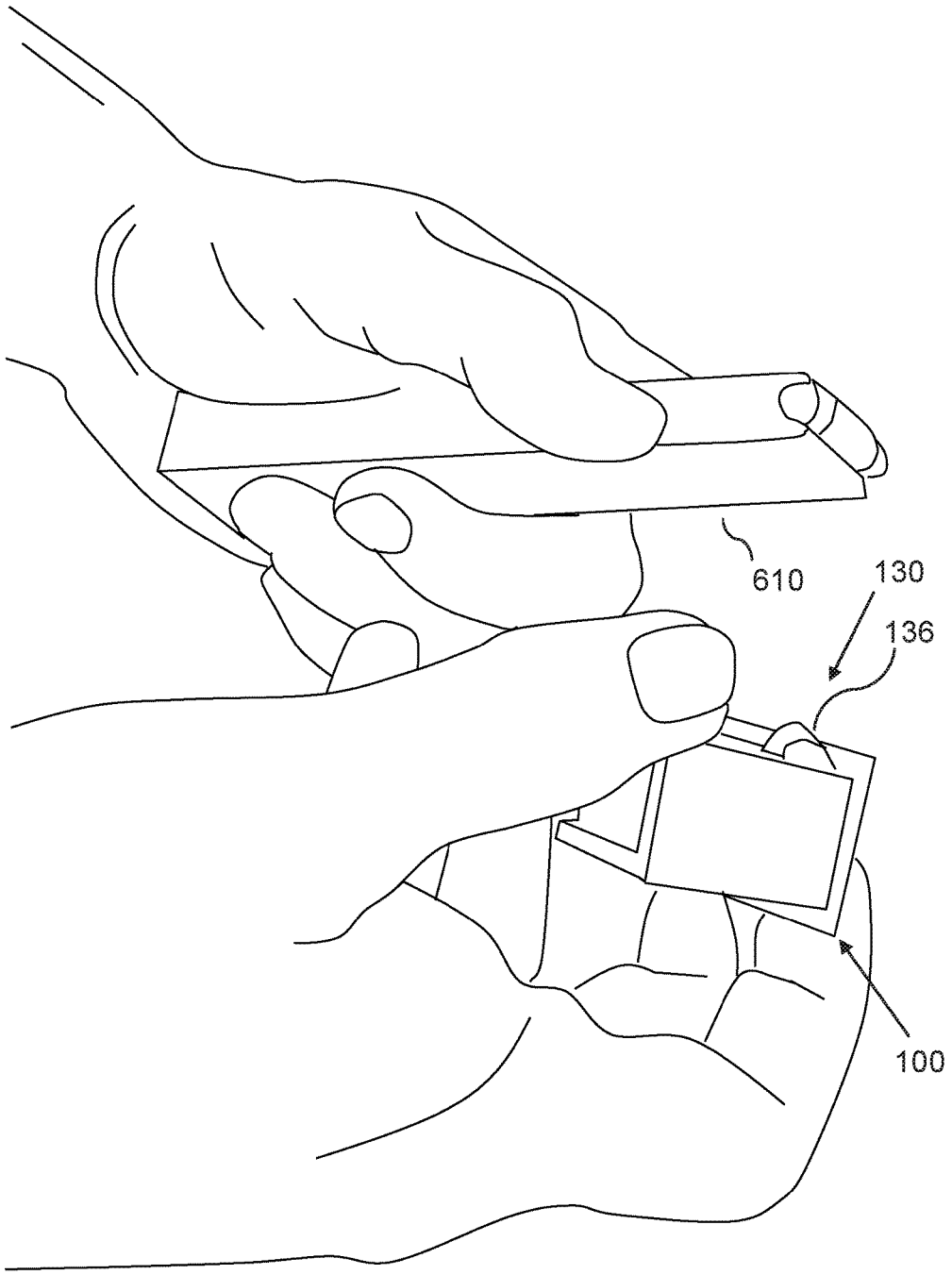
FIG. 7A is a perspective view of a magazine loader/unloader in use for unloading a magazine, according to an embodiment of the invention.
Figure 7B:
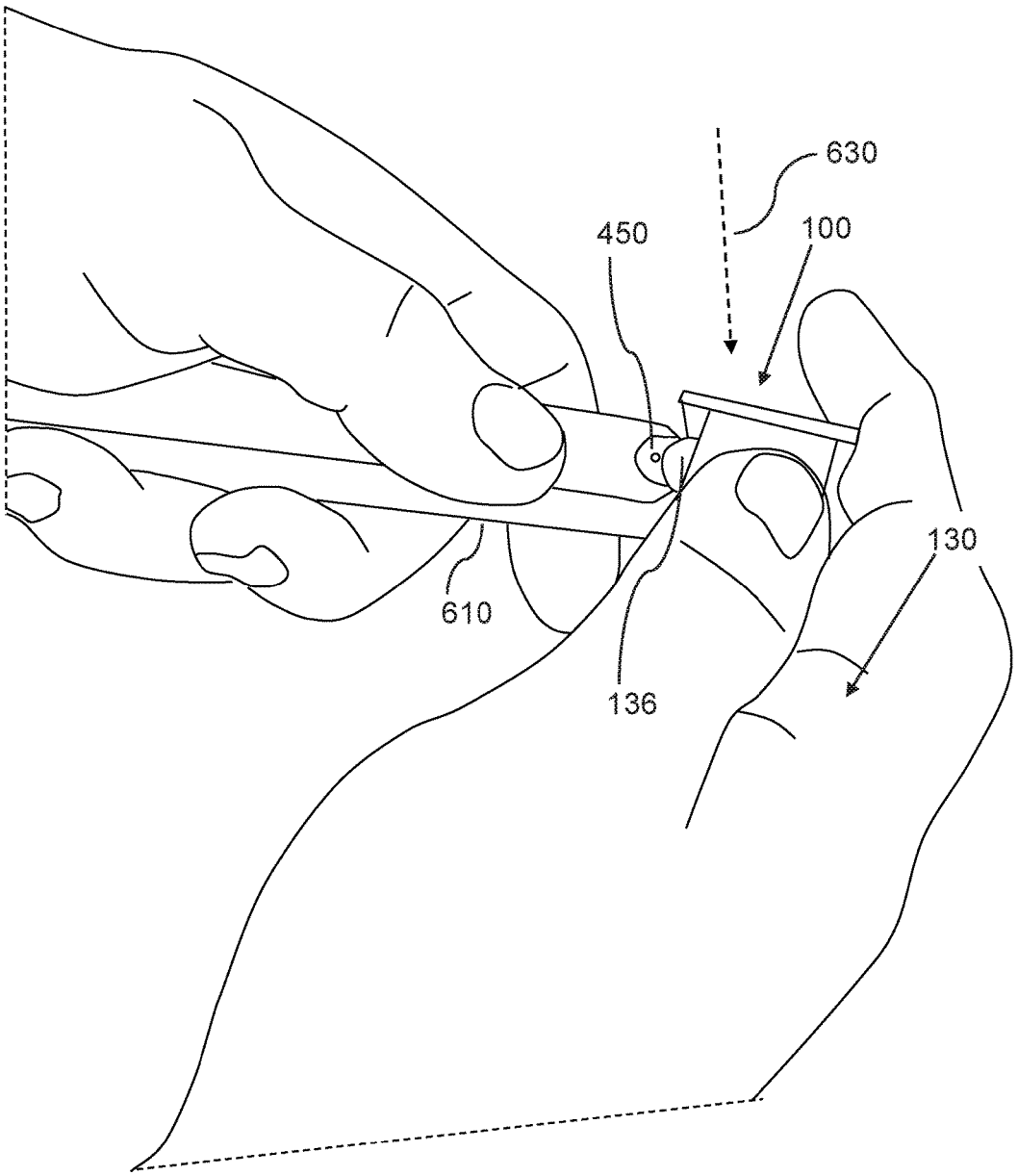
FIG. 7B is a perspective view of a magazine loader/unloader in use for unloading a magazine, according to an embodiment of the invention.

In an embodiment, as shown in FIGS. 1A, 1B, 2, 3, 4A, 4B, 5A and 5B, a magazine loader/unloader 100 can include:

a) A loader/unloader housing 110, including:
   - i. right and left sides 112 114;
   - ii. a front side 113, which connects between front end of the right and left sides 112 114;
   - iii. a rear side 115, which connects between rear ends of the right and left sides 112 114; and
   - iv. a bottom plate 118, which is connected to bottom ends of the right, left, front and rear sides 112 114 113 115, such that the bottom plate 118 has a flat bottom surface, such that the magazine loader/unloader 100 can be positioned for use on a flat surface 180, such as a table 180;

such that the loader/unloader housing 110 is hollow and defines a housing interior 119, which is accessible via an upper opening 116; such that the loader/unloader housing 110, as shown in FIGS. 6A and 6B, is configured to accept an upper end 612 of a firearm magazine 610, via insertion of the firearm magazine 610 through the upper opening 116;

b) A loading structure 120, including:
   - i. a loading member 122, which further comprises an upper surface 123, which can be configured as a half-cylinder, such that the upper surface is configured to accept a firearm cartridge 450, as shown in FIG. 4B, such that the loading member 122 is mounted inside the housing interior, such that the upper surface is mounted with a loading inclination angle 425 relative to the bottom plate 118, such that the upper surface is inclined downward 142 in a forward direction 144, which can also be described such that the upper surface 123 protrudes upward and rearward from a front end of the upper surface 123, such that the upper surface is configured to receive an firearm cartridge 450;

wherein, as shown in FIGS. 4B, 6A and 6B, when an firearm cartridge 450 is inserted into the housing interior 119 and positioned on the upper surface 123 of the loading member 122, and the firearm magazine 610 is depressed downward 620 into the housing interior 119, the loading member 122, depresses the firearm cartridge 450 into the firearm magazine 610, whereby the firearm cartridge 450 is securely positioned within the firearm magazine 610, which can also be referred to as being securely loaded or securely seated in the firearm magazine 610;

c) An unloading structure 130, which is mounted on an outer side of the loader/unloader housing 110, which for example can be either an outer side of the right or left sides 112 114, the unloading structure 130 including:
   - i. Optionally, a top guide 132, which is a first elongated member 132 mounted on the outer side of the unloader housing;
   - ii. Optionally, a bottom guide 134, which is a second elongated member 134 mounted on the outer side of the unloader housing, such the bottom guide 134 can be formed by the bottom plate 118 protruding out from the outer side, i.e. for example the side wall 112; and
   - iii. An unloading protrusion 136;

wherein the bottom guide 134 is parallel to the top guide 132 and positioned below the top guide 132;

such that the top and bottom guides 132 134 are configured to guide a smooth forward motion of the of the firearm magazine 610 and ensure positioning of the firearm cartridge 450 relative to the unloading protrusion, such that the unloading protrusion 136 engages the firearm cartridge 450;

wherein the top and bottom guides 132 134 can be perpendicular to a front flat surface 137 of the unloading protrusion 136;

wherein, as shown in FIGS. 7A and 7B, when the unloading structure 130 is placed on the upper end 612 of the firearm magazine 610, such that the unloading protrusion 136 is positioned against a rear of the firearm magazine 610 and the magazine loader/unloader 100 is pushed forward: the unloading protrusion 136 engages with a rear end 452 of the firearm cartridge 450 and move the firearm cartridge 450 forward, such that the firearm cartridge 450 is ejected from the firearm magazine 610.

In related embodiments, the magazine loader/unloader 100 can be designed to allow hand-held operation during loading, in addition to unloading use when positioned for use on a flat surface 180, such as a table 180.

In a related embodiment, the loading inclination angle 425 can be in a range of 15 to 85 degrees.

In related embodiment, as shown in FIGS. 1B, 2, 3, and 4B, the loader/unloader housing can further comprise:

a) an inner floor 135, which is mounted inside the housing interior 119, such that the loading member 122 is connected to an upper surface of the inner floor;

wherein the inner floor 135 can be inclined downward in the forward direction, at a floor inclination angle 427 relative to the bottom plate 118;

such that the inner floor 135 is configured to create (which can also be referred to as promote, support, or allow) a forward motion of the firearm cartridge, when the firearm magazine is depressed downward 620 into the housing interior 119, such that the firearm cartridge 450 is pressed downward and rearward into the firearm magazine 610, when the firearm cartridge 450 is securely loaded within the firearm magazine 610.

In various further related embodiments, the loading and floor inclination angles 425 427 can be configured to adapt to a particular design (i.e. make and model) of a firearm magazine 610.

In another further related embodiment, the loading inclination angle 425 can be equal to the floor inclination angle 427.

Figure 4C:
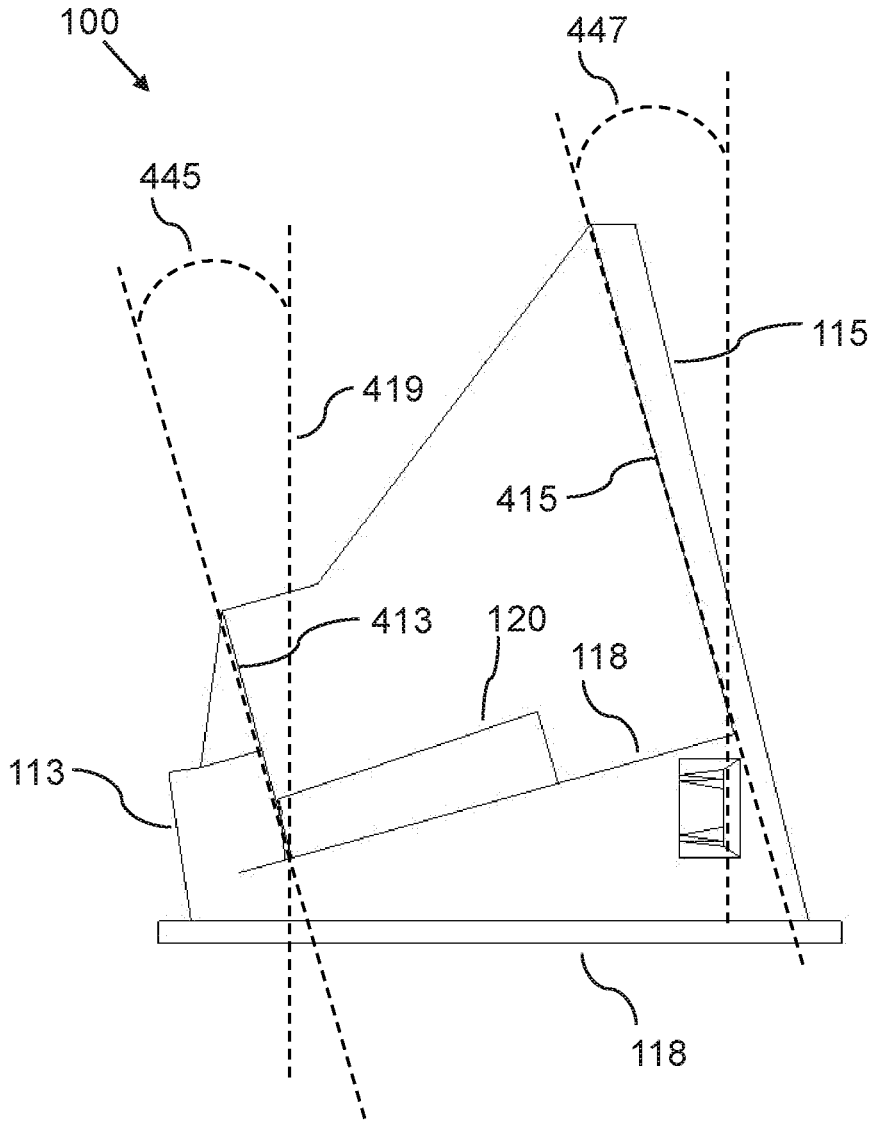
FIG. 4C is a side cross-sectional view of a magazine loader/unloader, according to an embodiment of the invention.

In a related embodiment, as shown in FIG. 4C, a front inner side 413 of the front side 113 can be configured with a forward inclination at a front inclination angle 445 relative to a vertical line 419, to guide a forward inclined position of the firearm magazine 610, such as shown in FIG. 6B.

In a further related embodiment, the front inner side 413 can be perpendicular to the inner floor 135.

In another related embodiment, as shown in FIG. 4C, a rear inner side 415 of the rear side 115 can be configured with a forward inclination at a rear inclination angle 447 relative to a vertical line 419, to guide a forward inclined position of the firearm magazine 610, such as shown in FIG. 6B.

Figure 5A:
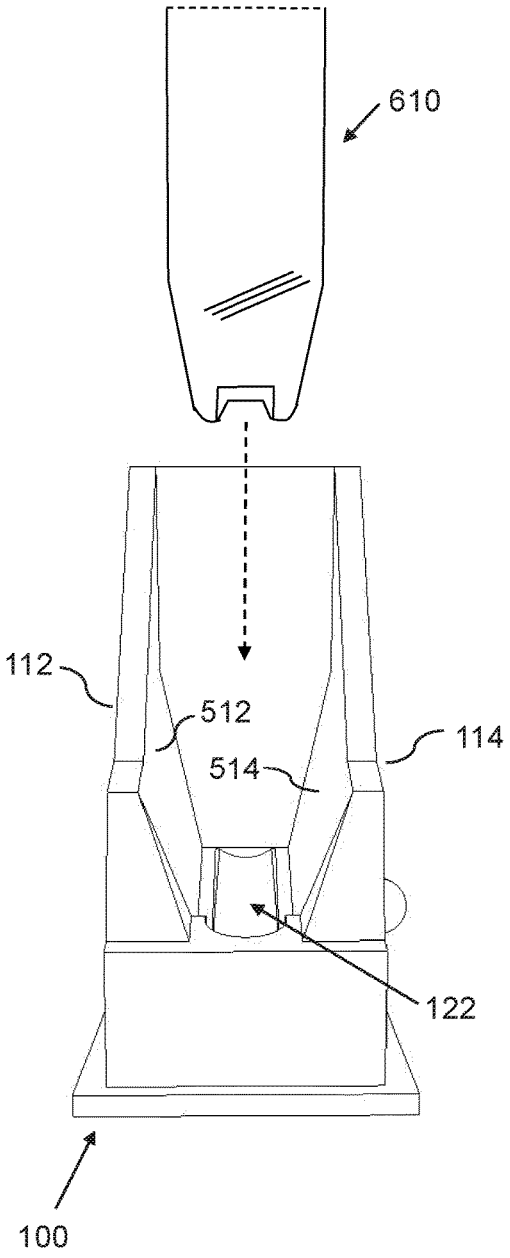
FIG. 5A is a front top perspective view of a magazine loader/unloader, according to an embodiment of the invention.
Figure 5B:
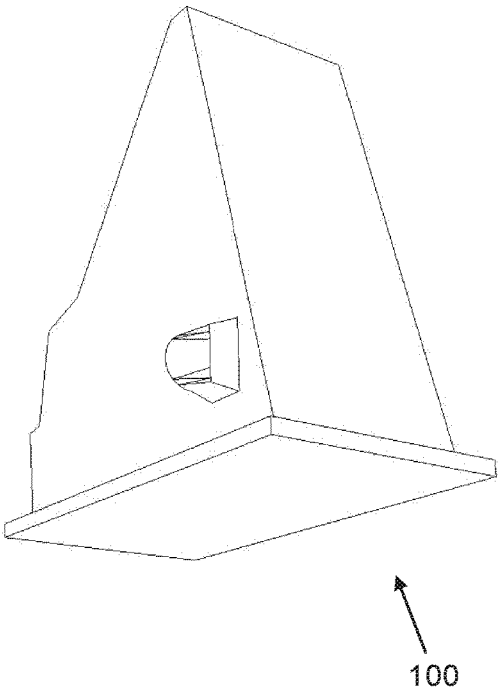
FIG. 5B is a rear bottom perspective view of a magazine loader/unloader, according to an embodiment of the invention.

In a related embodiment, as shown in FIG. 5A, lower parts of right and left inner sides 512 514 of respectively the right and left sides 112 114 can be configured with an inward taper, such that the housing interior 119 narrows toward a bottom of the housing interior, such that the housing interior 119 is configured to adapt to a tapered end of a firearm magazine.

In a further related embodiment, the rear inner side 415 can be perpendicular to the inner floor 135.

Figure 4D:
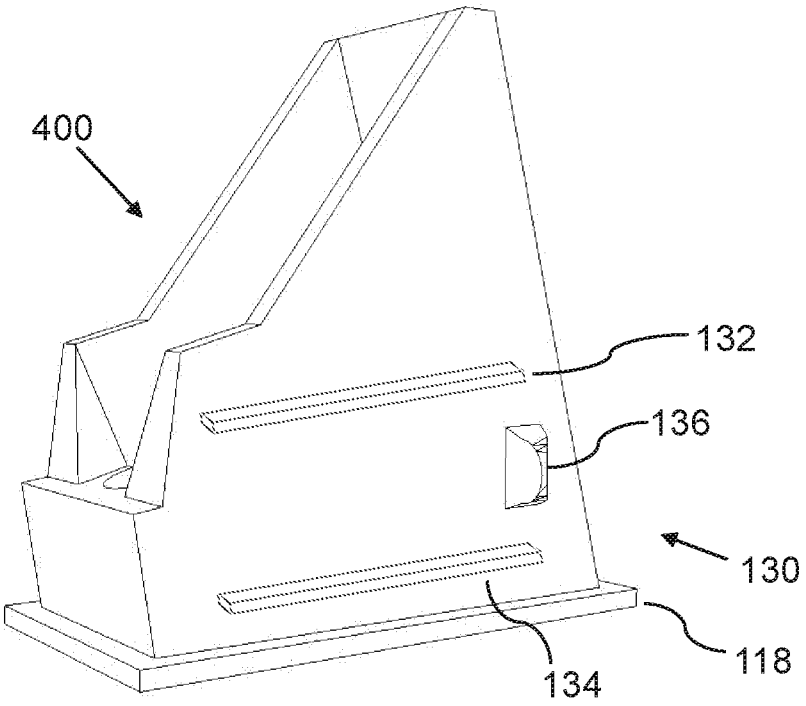
FIG. 4D is a side perspective view of a magazine loader/unloader, according to an embodiment of the invention.

In a related embodiment, as shown in FIG. 4D, the magazine loader/unloader 400 can be configured with an unloading structure 130 that is independent from the bottom plate 118, such that the bottom guide 134 is separate from the bottom plate 118, such that the bottom plate 118 does not need to be protruding. In further related embodiments, the unloading structure may be positioned in other orientations, such as vertical, such that the top and bottom guides 132 134 can alternatively be referred to as first and second guides 132 134, or right and left guides 132 134.

In a related embodiment, the magazine loader/unloader 100 can be manufactured as one piece, for example by injection molding or by additive manufacturing, such as fused deposition modeling. Alternatively, the magazine loader/unloader 100 can be assembled from separate pieces that are for example glued or fused together. The magazine loader can be made of a plastic material, or other suitable materials, such as metal, including rubber or plastic coated metal.

In related embodiments, the magazine loader/unloader 100 can be configured for use with a single stack magazine 610, such as shown in FIGS. 1A, 2A, 3, and 4, or for use with a double stack magazine 610, with a wider housing interior 119, such as shown in FIGS. 4A, 4B, 5A, and 5B.

Figure 8:
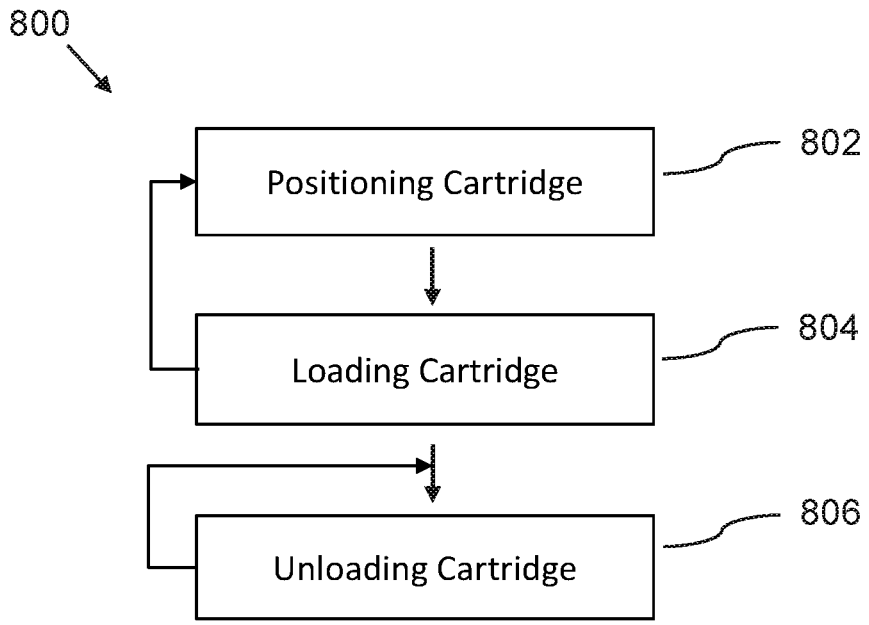
FIG. 8 is a flowchart illustrating steps that may be followed, in accordance with one embodiment of a method or process of using a magazine loader/unloader.

In an embodiment, a method of using the magazine loader/unloader 800, as shown in FIG. 8, can include:

a) Positioning cartridge 802, wherein an firearm cartridge 450 is positioned on an upper surface 123 of a loading member 122, which is mounted inside a housing interior 119 of a magazine loader/unloader 100;

b) Loading cartridge 804, including:

i. Depressing the firearm magazine 610 downward 620 into the housing interior 119, such that the loading member 122, depresses the firearm cartridge 450 into the firearm magazine 610; and subsequently ii. moving the magazine 610 in a forward motion 630, which pushes the firearm cartridge 450 rearward in the firearm magazine 610, whereby the firearm cartridge 450 is securely loaded within the firearm magazine 610;

wherein the process of inserting cartridge 802 and loading cartridge 804 can be repeated until the firearm magazine 610 is full; and c) Unloading cartridge 806, wherein the magazine loader/unloader 100 is held on a side that includes a unloading structure 130, and is placed on a top of the firearm magazine 610, such that the unloading protrusion 136 is positioned against a rear of the firearm magazine 510, such that the magazine loader/unloader 100 is pushed forward 610, such that the unloading protrusion 136 engages with a rear end 452 of the firearm cartridge 450 and moves the firearm cartridge 450 forward, such that the firearm cartridge 450 is ejected from the firearm magazine 610;

wherein the bottom guide 134 is parallel to the top guide 132 and positioned below the top guide 132;

wherein the top and bottom guides 132 134 ensure a smooth forward sliding motion and ensures positioning of the unloading protrusion 136, such that the unloading protrusion 136 engages the firearm cartridge 450;

wherein the firearm magazine 610 can be emptied by sliding the magazine loader/unloader 100 back to the original position and repeating unload cartridge 806 until the firearm magazine 610 is unloaded to a desired level, such as for example completely unloaded.

Here has thus been described a multitude of embodiments of the magazine loader/unloader 100 and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A magazine loader/unloader, comprising:

a) a loader/unloader housing, which is hollow and defines a housing interior with an upper opening, such that the loader/unloader housing is configured to accept an upper end of a firearm magazine, via insertion of the firearm magazine through the upper opening;

b) a loading structure, comprising:

a loading member, which is mounted inside the housing interior, wherein the loading member comprises an upper surface that is configured to accept a firearm cartridge; and c) a bottom plate, which is connected to a bottom end of the loader/unloader housing;

wherein the loader/unloader housing further comprises:

an inner floor, which is mounted inside the housing interior, such that the loading member is connected to an upper surface of the inner floor;

wherein the inner floor is inclined downward in a forward direction, at a floor inclination angle relative to the bottom plate;

such that the inner floor is configured to create a forward motion of the firearm cartridge, when the firearm magazine is depressed downward into the housing interior, such that the firearm cartridge is pressed downward and rearward into the firearm magazine;

wherein, when the firearm cartridge is inserted into the housing interior and positioned on the upper surface of the loading member, and the firearm magazine is depressed downward into the housing interior, the loading member is configured to depress the firearm cartridge into the firearm magazine, whereby the firearm cartridge is securely loaded within the firearm magazine.

2. The magazine loader/unloader of claim 1, wherein the upper surface is configured as a half-cylinder.

3. The magazine loader/unloader of claim 1, wherein the upper surface is configured with a loading inclination angle relative to the bottom plate, such that the upper surface is inclined downward in a forward direction.

4. The magazine loader/unloader of claim 3, wherein the loading inclination angle is in a range of 15 to 85 degrees.

5. The magazine loader/unloader of claim 1, wherein the loader/unloader housing further comprises:

a) right and left sides; and b) a bottom plate, which is connected to bottom ends of the right and left sides, wherein the bottom plate is configured with a flat bottom surface such that the magazine loader/unloader is configured to be positioned for use on a flat surface.

6. The magazine loader/unloader of claim 5, wherein the loader/unloader housing further comprises:

a) a front side, which connects between front parts of the right and left sides; and b) a rear side, which connects between rear parts of the right and left sides.

7. The magazine loader/unloader of claim 1, further comprising:

an unloading structure, which is mounted on an outer side of the loader/unloader housing, the unloading structure comprising:

an unloading protrusion;

wherein, when the unloading structure is placed on a top of the firearm magazine, such that when the unloading protrusion is positioned against a rear of the firearm magazine and the magazine loader/unloader is pushed forward, the unloading protrusion is configured to engage with a rear end of the firearm cartridge and move the firearm cartridge forward, such that the firearm cartridge is ejected from the firearm magazine.

8. The magazine loader/unloader of claim 7, wherein the unloading structure further comprises:

a bottom guide, which is a first elongated member mounted on the outer side of the unloader housing, such that the bottom guide is formed by the bottom plate protruding out from the outer side;

such that the bottom guide is configured to guide a smooth forward motion of the firearm magazine and ensure positioning of the firearm cartridge relative to the unloading protrusion, such that the unloading protrusion engages the firearm cartridge.

9. The magazine loader/unloader of claim 8, wherein the unloading structure further comprises:

a top guide, which is a second elongated member mounted on the outer side of the unloader housing;

wherein the top guide is parallel to the bottom guide and wherein the top guide is positioned above the bottom guide;

such that the top and bottom guides are configured to guide the smooth forward sliding motion of the firearm magazine and ensure the positioning of the firearm cartridge relative to the unloading protrusion.

10. The magazine loader/unloader of claim 1, wherein the upper surface is configured with a loading inclination angle relative to the bottom plate, such that the upper surface is inclined downward in a forward direction, wherein the loading inclination angle is equal to the floor inclination angle.

11. The magazine loader/unloader of claim 6, wherein a front inner side of the front side is configured with a forward inclination at a front inclination angle relative to a vertical line, whereby the front side is configured to guide a forward inclined position of the firearm magazine.

12. The magazine loader/unloader of claim 6, wherein a rear inner side of the rear side is configured with a forward inclination at a rear inclination angle relative to a vertical line, whereby the rear side is configured to guide a forward inclined position of the firearm magazine.

13. The magazine loader/unloader of claim 5, wherein lower parts of right and left inner sides of respectively the right and left sides are configured with an inward taper, such that the housing interior narrows toward a bottom of the housing interior, whereby the housing interior is configured to adapt to a tapered end of the firearm magazine.

14. A magazine loader/unloader, comprising:

a) a loader/unloader housing; and b) an unloading structure, which is mounted on an outer side of the loader/unloader housing, the unloading structure comprising:

an unloading protrusion; and a bottom guide, which is a first elongated member mounted on the outer side of the unloader housing;

such that the bottom guide is configured to guide a smooth forward motion of a firearm cartridge and ensure positioning of the firearm cartridge relative to the unloading protrusion, such that the unloading protrusion engages the firearm cartridge;

wherein, when the unloading structure is placed on a top of a firearm magazine, such that when the unloading protrusion is positioned against a rear of the firearm magazine and the magazine loader/unloader is pushed forward, the unloading protrusion is configured to engage with a rear end of a firearm cartridge in the firearm magazine and move the firearm cartridge forward, such that the firearm cartridge is ejected from the firearm magazine.

15. The magazine loader/unloader of claim 14, wherein the unloading structure further comprises:

a top guide, which is a second elongated member mounted on the outer side of the unloader housing; and wherein the top guide is parallel to the bottom guide and wherein the top guide is positioned above the bottom guide;

such that the top and bottom guides are configured to guide the smooth forward sliding motion of the firearm cartridge and ensure the positioning of the unloading protrusion.

16. The magazine loader/unloader of claim 14, wherein the loader/unloader housing further comprises:

a) right and left sides; and b) a bottom plate, which is connected to bottom ends of the right and left sides, wherein the bottom plate is configured with a flat bottom surface such that the magazine loader/unloader is configured to be positioned for use on a flat surface;

wherein the bottom guide is formed by the bottom plate protruding out from the outer side of the loader/unloader housing.

17. The magazine loader/unloader of claim 14, wherein the loader/unloader housing is hollow and defines a housing interior with an upper opening, such that the loader/unloader housing is configured to accept an upper end of the firearm magazine, via insertion of the firearm magazine through the upper opening; and the magazine loader/unloader further comprises:

a loading structure, comprising:

a loading member, which is mounted inside the housing interior, wherein the loading member comprises an upper surface that is configured to accept the firearm cartridge;

which is hollow and defines a housing interior with an upper opening, such that the loader/unloader housing is configured to accept an upper end of a firearm magazine, via insertion of the firearm magazine through the upper opening wherein, when the firearm cartridge is inserted into the housing interior and positioned on the upper surface of the loading member, and the firearm magazine is depressed downward into the housing interior, the loading member is configured to depress the firearm cartridge into the firearm magazine, whereby the firearm cartridge is securely loaded within the firearm magazine.

18. The magazine loader/unloader of claim 17, wherein the upper surface is configured as a half-cylinder.

19. The magazine loader/unloader of claim 17, further comprising:

a bottom plate, which is connected to a bottom end of the loader/unloader housing;

wherein the upper surface is configured with a loading inclination angle relative to the bottom plate, such that the upper surface protrudes upward and rearward from a front end of the upper surface.

20. A method of using a magazine loader/unloader, comprising:

a) inserting cartridge, wherein a firearm cartridge is positioned on an upper surface of a loading member, which is mounted inside a housing interior of the magazine loader/unloader;

b) loading cartridge, comprising:

depressing a firearm magazine downward into the housing interior, such that the loading member, depresses the firearm cartridge into the firearm magazine, whereby the firearm cartridge is securely loaded within the firearm magazine;

wherein the magazine loader/unloader comprises:

a loader/unloader housing, which is hollow and defines the housing interior with an upper opening, such that the loader/unloader housing is configured to accept an upper end of the firearm magazine, via insertion of the firearm magazine through the upper opening; and a loading structure, comprising:

the loading member, which is mounted inside the housing interior, wherein the loading member comprises the upper surface that is configured to accept the firearm cartridge; and an unloading structure, which is mounted on an outer side of the loader/unloader housing, the unloading structure comprising:

an unloading protrusion; and a bottom guide, which is a first elongated member mounted on the outer side of the unloader housing;

such that the bottom guide is configured to guide a smooth forward motion of a firearm cartridge and ensure positioning of the firearm cartridge relative to the unloading protrusion, such that the unloading protrusion engages the firearm cartridge;

wherein, when the firearm cartridge is inserted into the housing interior and positioned in the loading member, and the firearm magazine is depressed downward into the housing interior, the loading member is configured to depress the firearm cartridge into the firearm magazine, whereby the firearm cartridge is securely loaded within the firearm magazine.

21. The method of using a magazine loader/unloader of claim 20, further comprising:

unloading cartridge, wherein the magazine loader/unloader is held on a side that includes the unloading structure with an unloading protrusion, such that the unloading structure is placed on a top of the firearm magazine, such that the unloading protrusion is positioned against a rear of the firearm magazine, such that the magazine loader/unloader is pushed forward, such that the unloading protrusion engages with a rear end of the firearm cartridge and moves the firearm cartridge forward, such that the firearm cartridge is ejected from the firearm magazine.

22. A magazine loader/unloader, comprising:

a) a loader/unloader housing, which is hollow and defines a housing interior with an upper opening, such that the loader/unloader housing is configured to accept an upper end of a firearm magazine, via insertion of the firearm magazine through the upper opening;

b) a loading structure, comprising:

a loading member, which is mounted inside the housing interior, wherein the loading member comprises an upper surface that is configured to accept a firearm cartridge;

c) a bottom plate, which is connected to a bottom end of the loader/unloader housing; and d) an unloading structure, which is mounted on an outer side of the loader/unloader housing, the unloading structure comprising:

an unloading protrusion; and a bottom guide, which is a first elongated member mounted on the outer side of the unloader housing, such that the bottom guide is formed by the bottom plate protruding out from the outer side;

wherein, when the unloading structure is placed on a top of the firearm magazine, such that when the unloading protrusion is positioned against a rear of the firearm magazine and the magazine loader/unloader is pushed forward, the unloading protrusion is configured to engage with a rear end of the firearm cartridge and move the firearm cartridge forward, such that the firearm cartridge is ejected from the firearm magazine, such that the bottom guide is configured to guide a smooth forward motion of the firearm magazine and ensure positioning of the firearm cartridge relative to the unloading protrusion, such that the unloading protrusion engages the firearm cartridge;

wherein, when the firearm cartridge is inserted into the housing interior and positioned on the upper surface of the loading member, and the firearm magazine is depressed downward into the housing interior, the loading member is configured to depress the firearm cartridge into the firearm magazine, whereby the firearm cartridge is securely loaded within the firearm magazine.

23. The magazine loader/unloader of claim 22, wherein the upper surface is configured with a loading inclination angle relative to the bottom plate, such that the upper surface is inclined downward in a forward direction.

* * * * *